US010377550B1

(12) United States Patent
Tseng

(10) Patent No.: US 10,377,550 B1
(45) Date of Patent: Aug. 13, 2019

(54) STRUCTURE OF PAPER CUP WITH INTEGRATED OUTFLOW TUBE

(71) Applicant: NEWGO DESIGN STUDIO, Taichung (TW)

(72) Inventor: Chun-Lin Tseng, Taichung (TW)

(73) Assignee: NEWGO DESIGN STUDIO, Taichung (TW)

( * ) Notice: Subject to any disclaimer, the term of this patent is extended or adjusted under 35 U.S.C. 154(b) by 0 days.

(21) Appl. No.: 16/052,582

(22) Filed: Aug. 1, 2018

(51) Int. Cl.
*A47G 19/22* (2006.01)
*B65D 77/28* (2006.01)
*B65D 1/26* (2006.01)

(52) U.S. Cl.
CPC ..... *B65D 77/286* (2013.01); *A47G 19/2266* (2013.01); *B65D 1/265* (2013.01)

(58) Field of Classification Search
CPC ..... B65D 77/286; B65D 1/265; B65D 25/42; B65D 47/06; A47G 19/2266
USPC ..... 229/400, 103.1, 125.04, 4.5, 906.1; 220/710, 705, 708; 215/388; 206/217
See application file for complete search history.

(56) References Cited

U.S. PATENT DOCUMENTS 2,102,653 A * 12/1937 Smith ..... B65D 1/265 220/574
4,442,948 A * 4/1984 Levy ..... A47G 19/2227 206/218
5,495,982 A * 3/1996 Wang ..... B65D 5/3685 229/103.1
5,960,987 A * 10/1999 Solland ..... B65D 3/28 220/717
6,168,042 B1 * 1/2001 Kalagian ..... B65D 21/0233 206/217
2013/0240544 A1 * 9/2013 Lerner ..... A47G 19/2266 220/710

* cited by examiner

*Primary Examiner* — Christopher R Demeree
(74) *Attorney, Agent, or Firm* — Leong C. Lei

(57) ABSTRACT

A cup is provided with an outflow tube integrally formed therewith. A body of the cup is formed by winding a paper board such that an extended part of the paper board is preserved at a winding joint site of the cup body and is subjected to further winding to form an outflow tube that is initially flattened and attached flat to the cup body. A partition section that is between a containing space of the cup body and the outflow tube is provided with a discharge hole through which a liquid or beverage contained in the cup body is allowed to flow into the outflow tube. The outflow tube can be pressed for bulging into an expanded passage and a top end of the outflow tube that is initially closed is opened through tearing a fold or indent line to form an outflow opening.

2 Claims, 12 Drawing Sheets

STRUCTURE OF PAPER CUP WITH INTEGRATED OUTFLOW TUBE

(a) TECHNICAL FIELD OF THE INVENTION

The present invention relates generally to a structure of paper cup with integrated outflow tube, and more particularly to a structure of a beverage cup (or an aseptic-packaged beverage container) having a sidewall to which an outflow tube is integrally attached for immediate use for drinking and other purposes.

(b) DESCRIPTION OF THE PRIOR ART

Plastics have been widely used nowadays and are one of the "monsters" that severely destroys the ecologic environment of human beings. All the nations around the world have stipulated severe regulations to control the use of such forever-lasting materials. New legislations have been made in Taiwan to prohibit plastic bags that have been commonly used in daily living from being supplied freely for holding and carrying purchased products. Further, beverages are now supplied as being filled in paper cups. Even more, plastic drinking straws will be completely prohibited as of July 2019. However, the modern diet culture is generally "fast" and "convenient" and thus, each individual holding a cup of beverage in a public site is a commonly observed in the modern society. To drink beverage from a cup, a plastic straw is often used by insertion into the cup for sucking and thus drinking the beverage. This is certainly opposite to the intention of reducing or prohibiting use of plastic straws. Additional shortcomings, as described below, may be present. (1) The opening of a cup may be sealed and closed with a plastic film and a drinking straw must pierce through the plastic film to get into the liquid (or beverage) held in the cup for drinking; however, with the sealing film so pierced, in case that the beverage is not consumed immediately, foreign objects or bacteria may invade along the straw to eventually cause unpredictable damage to the health of the user. (2) Beverage is sucked from the cup by using the straw; however, the straw is an additional object, which is a necessary evil thing that would cause catastrophe to the ecologic system.

Further, although a different structure has been available for cupped beverage in which a cover is set on and attached to an opening of a cup and includes a small lid that can be lifted to expose a drinking hole. The use of the cover, which is also made of plastics, is also adverse to reducing or preventing use of plastics. In addition, the cover is often made of injection molding and would require an increased amount of plastics consumed in the fabrication thereof and would definitely cause an even severer consequence.

SUMMARY OF THE INVENTION

Thus, in view of the fact that the conventional beverage cup that is not provided with a sucking measure attached thereto must be provided with a drinking straw inserted therein for drinking, and the additionally provided drinking straw often cause damage to ecology, the present invention is made to a solution for such a problem in order to provide an ultimate measure for handling the issue of an additional straw being used with cupped water or cupped beverage to achieve a purpose of providing a cup body integrally formed with an outflow tube.

In view of the above, the primary technical solution of the present invention generally comprises: a cup body formed with an integrated outflow tube, through winding a paper board, and generally comprising a secondary-winding part provided at a winding joint site of the cup body to form, through winding, the outflow tube, with the cup body and the outflow tube respectively defining a containing space for liquid (or beverage) and egress passage for outflow, wherein the outflow tube formed through the secondary winding is formed in a flattened configuration that is attached to and laid flat on an outside surface of a sidewall of the cup body and a fold or indent line is formed in an top end part of the outflow tube. When the flattened outflow tube is pressed to bulge and the fold or indent line at the top end part is tom apart, an opening for outflow is formed. Beverage that flows through a discharge hole formed in a lower end part of a partition section between the liquid containing space of the cup body and the outflow tube to flow out of the cup body can be poured out through tilting the cup body or can be sucked out to thereby provide an effect of easy drinking.

The above-described technical solution of the present invention provides the following advantages: (1) The cup body is provided, through winding, to include an integrated outflow tube, so that when a top opening of the cup body is closed and sealed by a plastic film, the outflow tube that accompanies the cup can be used to directly pour or drink the beverage; (2) by using the integrated outflow tube to drink, when the drinking is temporarily stopped, the outflow tube can be folded to laid flat on the sidewall of the cup body to provide a function of opening sealing, which helps prevents invasion of and contamination of the beverage by foreign objects so as to ensure safety and sanitation of food; (3) although the top opening of the cup body is closed and sealed by the plastic film, there is no need to tear or puncture the sealing film and drinking can be achieved with the outflow tube; and (4) the paper-made cup body is provided, integrally, with an outflow tube through winding so that drinking can be achieved without an additional drinking straw so that the purpose of plastics reduction and environmental protection can be achieved and an effect of cost lowering is also achieved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
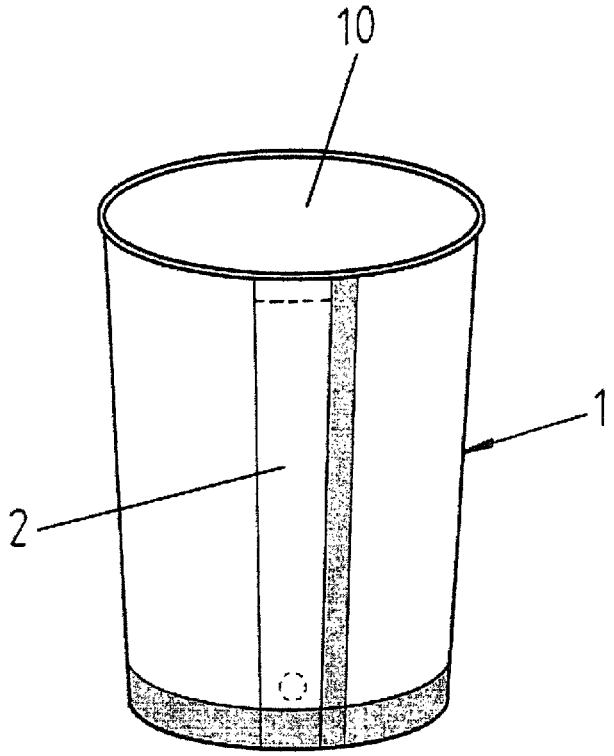
FIG. 1 is a perspective view showing a structure of paper cup according to a first embodiment of the present invention.
Figure 2:
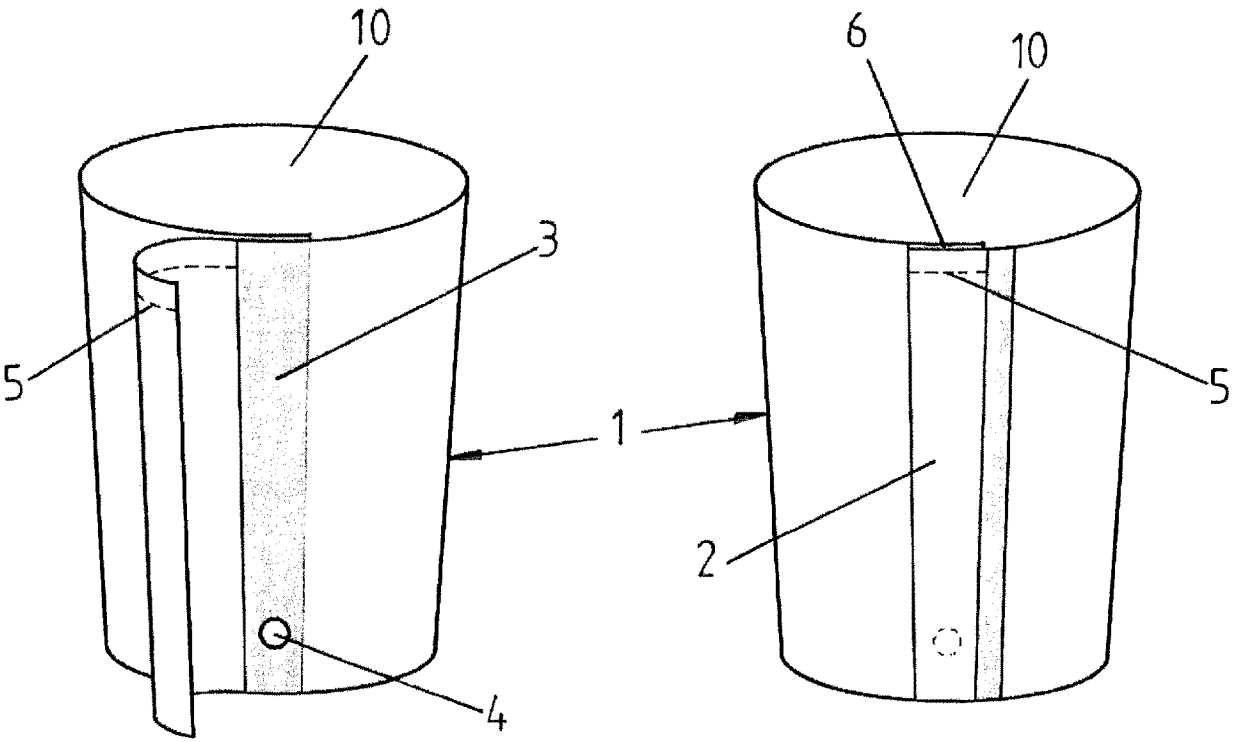
FIG. 2 is a schematic view illustrating two stages of a shaping operation of the structure of paper cup according to the first embodiment of the present invention.

Referring to FIGS. 1 and 2, the present invention is formed through a shaping process that is generally similar to a conventional paper cup and a paper board is rolled or wound to form a cup body, wherein a secondary-winding edge margin part is extended from and thus present at a joint site of the rolling or winding of the cup body (1) for subsequent winding to form an outflow tube (2) as an integrated part thereof and in the form of enclosed and flattened configuration attached and laid flat to a sidewall of the cup body (1). A discharge hole (4) is formed in a partition section (3) between a containing space (10) of the cup body (1) and the outflow tube (2). The outflow tube so formed on the cup body (1) is arranged to attach to and lay flat to an outside surface of the sidewall of the cup body, wherein the outflow tube (2) has an upper end that is formed as a closed tip (6), and comprises a fold or indent line (5) formed thereon at a location below the closed tip (6) to be torn apart in a later stage.

Figure 3:
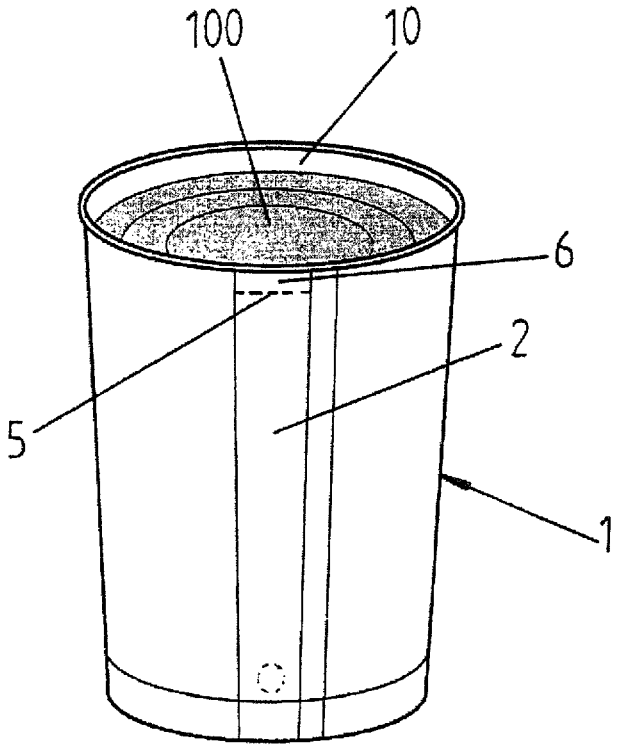
FIG. 3 is a schematic view illustrating the structure of paper cup according to the first embodiment of the present invention, as shown in FIG. 1, receiving and containing a liquid (or beverage) therein.
Figure 4:
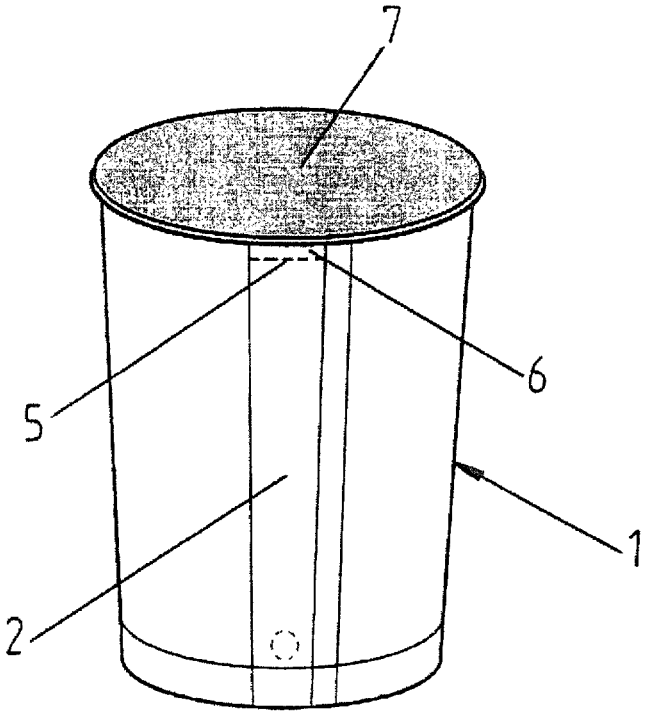
FIG. 4 is a schematic view illustrating the structure of paper cup according to the first embodiment of the present invention with an opening of the cup being closed and sealed.

Referring to FIG. 3, the cup body (1) can be filled with a liquid (or beverage) (100), and a sealing machine is used to add and attach a plastic film (7) (as shown in FIG. 4) to close and seal a top opening of the cup body so as to provide an opening-closed cup body (1).

Figure 5:
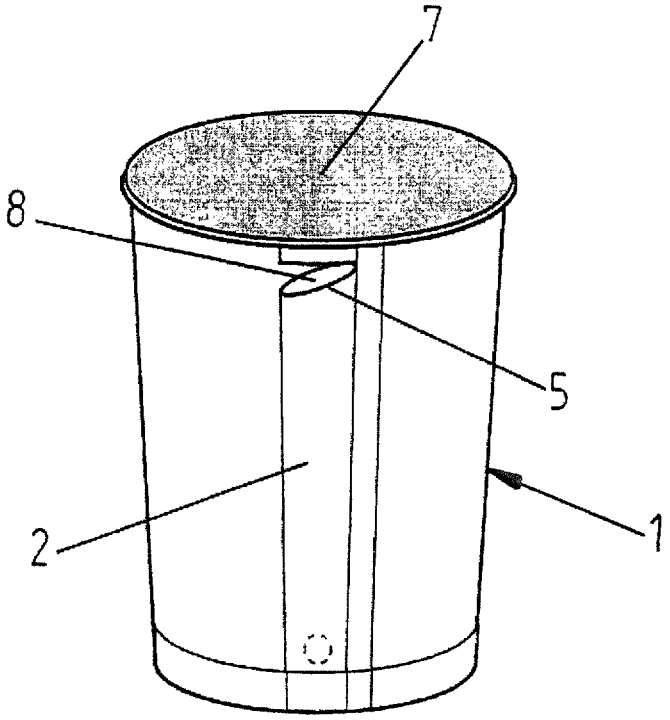
FIG. 5 is a schematic view showing the structure of paper cup according to the first embodiment of the present invention being operated to bulge an outflow tube and to tear off a fold or indent line to form a wide open outflow opening.

To consume the liquid (or beverage) (100) contained in the cup body (1), the outflow tube (2) that is flattened and attached flat to the sidewall of the cup body (1) is first pressed, from two opposite edges thereof, to bulge and thus form an expanded outflow tube (2). The fold or indent line (20) provided on or adjacent to the top end of the outflow tube (2) is then torn apart to form an outflow opening (8) (as shown in FIG. 5), so that the cup body is provided with an integrated drinking opening that has the same function as a drinking straw.

Figure 6:
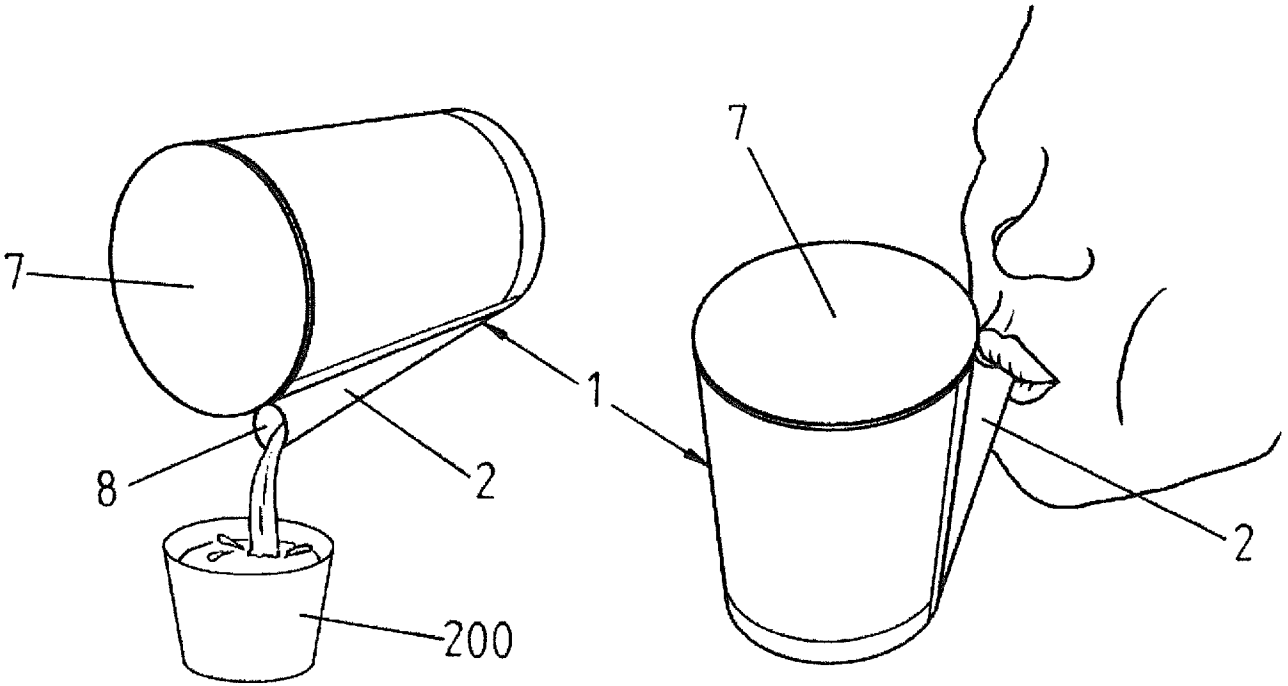
FIG. 6 is a schematic view illustrating two examples of use of the structure of paper cup according to the first embodiment of the present invention, one being that the cup is tilted to allow liquid (or beverage) to be poured into another container, the other being that the cup is placed upright to allow for drinking through sucking.

Further, as shown in FIG. 6, the cup body (1) that is filled with liquid (or beverage) (100) is closed and sealed with an opening-sealing film is operated by using fingers to press two opposite edges of the flattened outflow tube (2) that is laid flat on the sidewall of the cup body (1) to get bulged and form a cylindrical tube, whereby the liquid (or beverage) (100) contained in the containing space (10) of the cup body (1) is allowed to flow through the discharge hole (4) formed in a lower end part of the partition section (3) between the containing space (10) of the cup body (1) and the outflow tube (2) to get into the outflow tube (2) to then flow through the outflow opening (8) formed by tearing apart the fold or indent line (5) formed on a top end part of the outflow tube (2), allowing the liquid (or beverage) (100) contained in the cup body (1) to be poured, through tilting, by way of the outflow opening (8), into another container (200), or alternatively, allowing the liquid (or beverage) (100) to be sucked, for drinking, through the outflow opening (8) of the outflow tube (2) by placing the cup body (1) in an upright condition.

Figure 7:
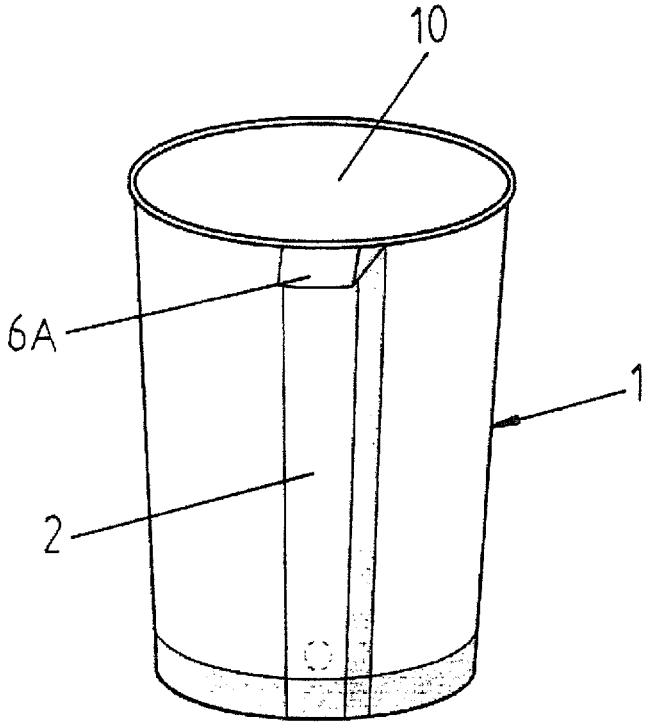
FIG. 7 is a perspective view showing a structure of paper cup according to a second embodiment of the present invention.
Figure 8:
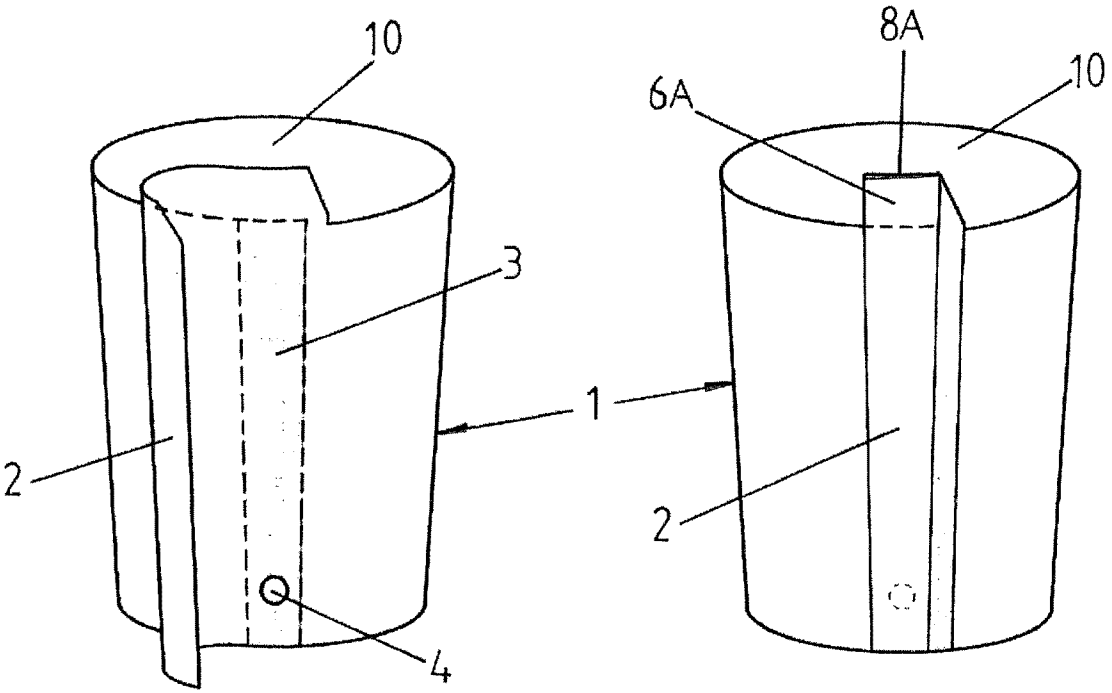
FIG. 8 is a schematic view illustrating two stages of a shaping operation of the structure of paper cup according to the second embodiment of the present invention.

Further, referring to FIGS. 7 and 8, the cup body (1) as described in the above embodiment, is arranged such that the secondary-winding edge margin part extended from the winding joint site of the paper board is further provided, at a top end thereof with an elongated projecting edge part, and is wound to form an outflow tube (2) that is integrated therewith and is attached and laid flat on a sidewall of the cup body (1) with the top end of the outflow tube (2) being closed and forming a projecting and folded closed tip (6A). The projecting and folded closed tip (6A) may be selectively folded upward to form an opening that projects beyond the cup body (1) to serve as a projecting straw for drinking.

Figure 9:
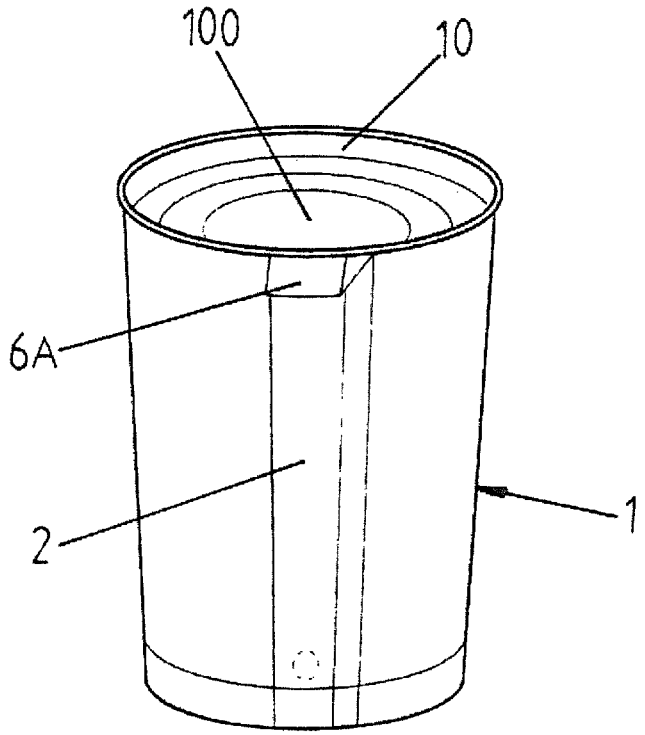
FIG. 9 is a schematic view illustrating the structure of paper cup according to the second embodiment of the present invention, as shown in FIG. 7, receiving and containing a liquid (or beverage) therein.
Figure 10:
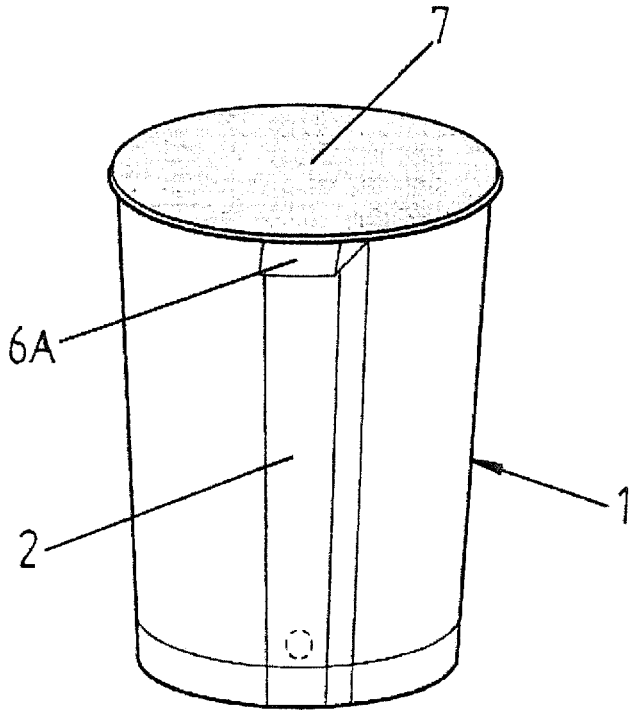
FIG. 10 is a schematic view illustrating the structure of paper cup according to the second embodiment of the present invention with an opening of the cup being closed and sealed.

Further, as shown in FIG. 9, the cup body (1) can be filled with a liquid (or beverage) (100), and a sealing machine is used to add and attach a plastic film (7) (as shown in FIG. 10) to close and seal a top opening of the cup body so as to provide an opening-closed cup body (1).

Figure 11:
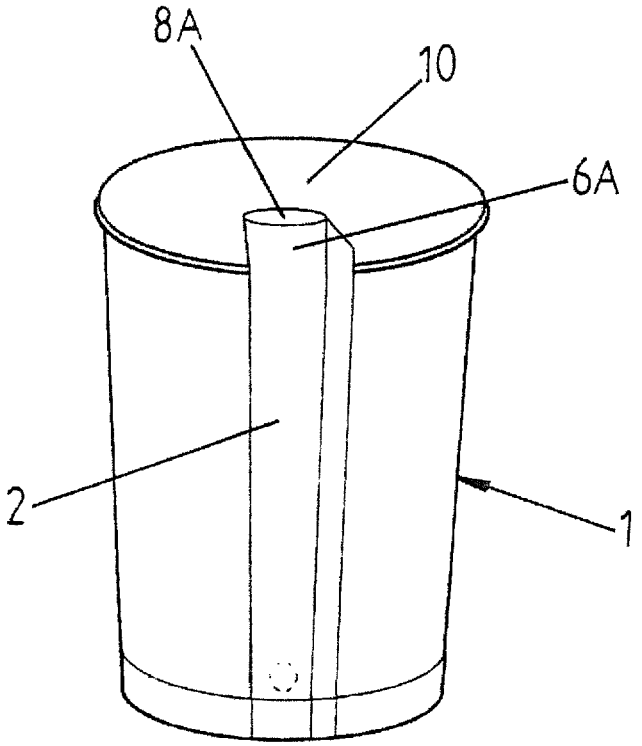
FIG. 11 is a schematic view showing the structure of paper cup according to the second embodiment of the present invention being operated to bulge an outflow tube and to tear off a fold or indent line to form a wide open outflow opening.

To consume the liquid (or beverage) (100) contained in the cup body (1), the outflow tube (2) that is flattened and attached flat to the sidewall of the cup body (1) is first pressed, from two opposite edges thereof, to bulge and thus form an expanded outflow tube (2), and the projecting and folded closed tip (6A) at the top end of the outflow tube (2) is folded or lifted upward to form an opening that projects beyond the opening of the cup body (1). A thumb and an associated index finger are then used to open the top end of the outflow tube (2) to form the outflow opening (8A) (as shown in FIG. 11), so that the cup body is provided with an integrated drinking opening that has the same function as a drinking straw.

Figure 12:
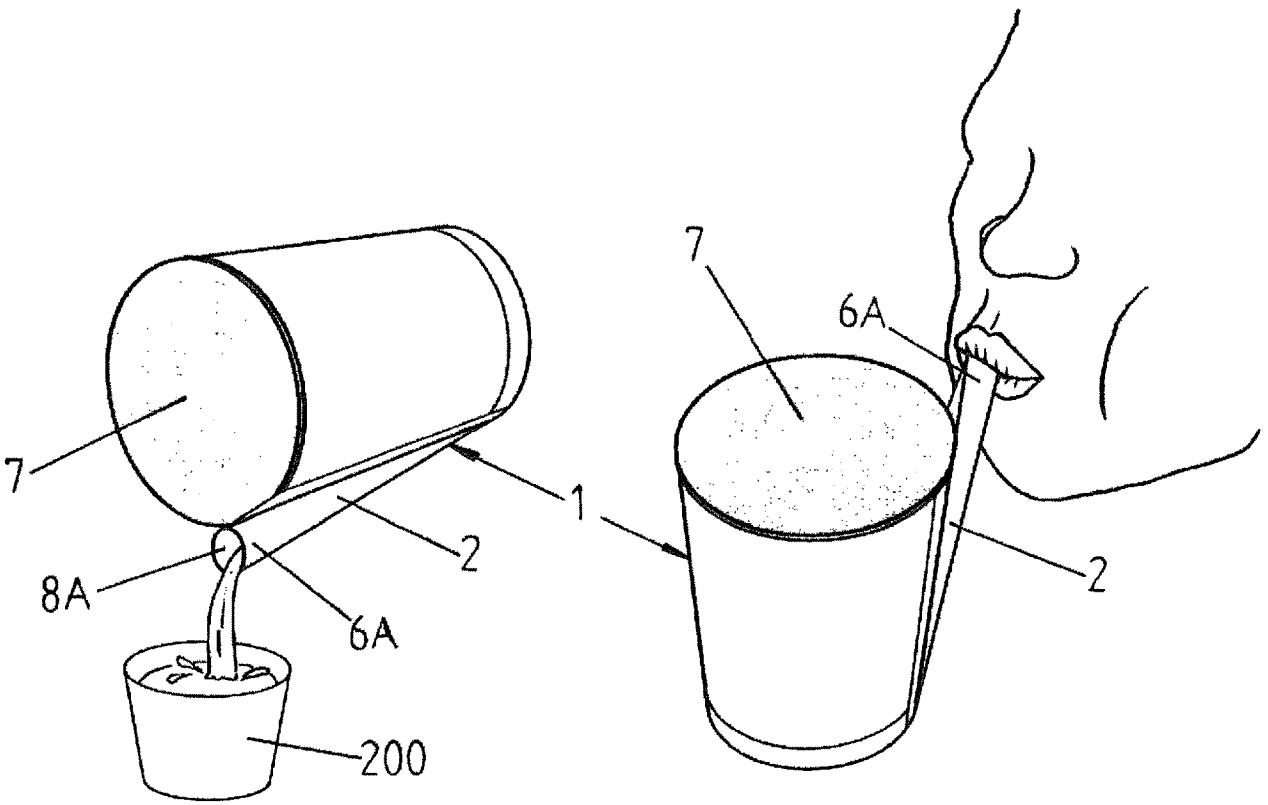
FIG. 12 is a schematic view illustrating two examples of use of the structure of paper cup according to the second embodiment of the present invention, one being that the cup is tilted to allow liquid (or beverage) to be poured into another container, the other being that the cup is placed upright to allow for drinking through sucking.

Further, as shown in FIG. 12, the cup body (1) that is filled with liquid (or beverage) (100) is closed and sealed with an opening-sealing film is operated by using fingers to press two opposite edges of the flattened outflow tube (2) that is laid flat on the sidewall of the cup body (1) to get bulged and form a cylindrical tube, and, also, the folded closed tip (6A) at the top end of the outflow tube (2) is lifted upward and pressed with two fingers to open the top end of the outflow tube (2) to form the outflow opening (8A) projecting upward, whereby the liquid (or beverage) (100) contained in the containing space (10) of the cup body (1) is allowed to flow through the discharge hole (4) formed in a lower end part of the partition section (3) between the containing space (10) of the cup body (1) and the outflow tube (2) to get into the outflow tube (2) to then flow through the outflow opening (8A) projecting from the top end of the outflow tube (2), allowing the liquid (or beverage) (100) contained in the cup body (1) to be poured, through tilting, by way of the outflow opening (8), into another container (200), or alternatively, allowing the liquid (or beverage) (100) to be sucked, for drinking, through the outflow opening (8) of the outflow tube (2) by placing the cup body (1) in an upright condition.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A structure of paper cup with integrated outflow tube, wherein a cup body has a structure that is provided with an outflow tube functioning like a drinking straw and integrally formed, through winding, therewith, the cup body being formed through winding a paper board, wherein a secondary-winding edge margin part is extended from and thus present at a joint site of winding of the cup body, the edge margin part being provided, at a top end thereof, with an elongate projecting edge part, and is wound to form the outflow tube that is integrated with and is flattened and laid flat on a sidewall of the cup body, a discharge hole being formed in a lower end part of a partition section between a containing space of the cup body and the outflow tube, the outflow tube having an upper end that is closed with a fold or indent line being formed at a location below the closed end, wherein to consume a liquid (or a beverage) contained in the cup body, the outflow tube that is flattened and attached flat to the sidewall of the cup body is pressed sideways to bulge and form an expanded outflow tube, and the fold or indent line provided on the top end of the outflow tube is torn to form an outflow opening, so that the cup body is provided with an integrated drinking opening that has the same function as a drinking straw;

wherein the paper board has a top edge and a bottom edge opposite to each other and two lateral side edges opposite to each other and connecting between the top edge and the bottom edge, wherein the secondary-winding edge margin part is extended from a single one of the two lateral side edges and is wound up to form the outflow tube, such that the outflow tube is formed with a part of the single one of the two lateral side edges of the paper board that extends between the top and bottom edges of the paper board.

2. A structure of paper cup with integrated outflow tube, wherein a cup body has a structure that is provided with an outflow tube functioning like a drinking straw and integrally formed, through winding, therewith, the cup body being formed through winding a paper board, wherein a secondary-winding edge margin part is extended from and thus present at a joint site of winding of the cup body, and is wound to form the outflow tube that is integrated with and is flattened and laid flat on a sidewall of the cup body with a top end of the outflow tube being closed and forming a projecting and folded closed end, a discharge hole being formed in a lower end part of a partition section between a containing space of the cup body and the outflow tube and in communication therewith, wherein to consume a liquid (or a beverage) contained in the cup body, the outflow tube that is flattened and attached flat to the sidewall of the cup body is pressed sideways to bulge and form an expanded outflow tube and the projecting and folded closed end at the top end of the outflow tube is folded and lifted upward to project above an opening of the cup body, pressing being carried out with a thumb and an index finger to open the top end of the outflow tube to form a projecting outflow opening, so that the cup body is provided with an integrated drinking opening that has the same function as a drinking straw;

wherein the paper board has a top edge and a bottom edge opposite to each other and two lateral side edges opposite to each other and connecting between the top edge and the bottom edge, wherein the secondary-winding edge margin part is extended from a single one of the two lateral side edges and is wound up to form the outflow tube, such that the outflow tube is formed with a part of the single one of the two lateral side edges of the paper board that extends between the top and bottom edges of the paper board.

* * * * *